United States Patent [19]

Nishimura et al.

[11] 4,434,770

[45] Mar. 6, 1984

[54] FUEL INJECTION TIMING SIGNAL AND CRANK ANGLE SIGNAL GENERATING APPARATUS

[75] Inventors: Hiroyuki Nishimura, Konosu; Shumpei Hasegawa, Niiza; Masahiro Watanabe, Sagamihara; Haruo Furuya, Yokohama, all of Japan

[73] Assignee: Matsushita Electric Industrial, Co. Ltd., Osaka; and Honda Giken Kogyo Kabushiki Kaisha, Tokyo, both of Japan

[21] Appl. No.: 348,427

[22] Filed: Feb. 12, 1982

[30] Foreign Application Priority Data

Feb. 17, 1981 [JP] Japan ..... 56-22580

[51] Int. Cl.[3] ..... F02D 5/02; F02B 3/00

[52] U.S. Cl. ..... 123/494; 123/478; 123/617; 123/476

[58] Field of Search ..... 123/478, 494, 617, 476

[56] References Cited

U.S. PATENT DOCUMENTS

| | | | |
|---|---|---|---|
| 3,881,453 | 5/1975 | Harper et al. | 123/494 |
| 3,915,131 | 10/1975 | Brungsberg | 123/617 |
| 4,245,605 | 6/1981 | Rice et al. | 123/478 |
| 4,265,210 | 5/1981 | Hanisko | 123/494 |
| 4,313,414 | 2/1982 | Planteline | 123/617 |
| 4,372,266 | 2/1983 | Hiyama et al. | 123/494 |

*Primary Examiner*—Raymond A. Nelli

*Attorney, Agent, or Firm*—Stevens, Davis, Miller and Mosher

[57] ABSTRACT

This invention discloses an engine rotation sensor which can generate angle- and timing-pulses from one sensor. The ratio of the intervals between these pulses generated by the rotation sensor is determined. The crank angle pulses and the timing pulses are discriminated depending on whether this ratio is less than or equal to a predetermined value, or not. The injection of fuel of each injector is controlled by a pulse which is discriminated as a timing pulse.

3 Claims, 6 Drawing Figures

FUEL INJECTION TIMING SIGNAL AND CRANK ANGLE SIGNAL GENERATING APPARATUS

The present invention relates to an apparatus for generating a fuel injection timing signal and a crank angle signal used for electronically controlling the fuel injection in automobile engines.

An electronic fuel injection control system is known, in which an injector is provided for each cylinder of an automobile engine, and the quantity of fuel injection is calculated based on information of engine speed, intake manifold pressure, etc., and a fuel injection control signal is sequentially applied to each injector at a predetermined timing thereby to inject the fuel into the cylinder.

The electronic fuel injection control system of this kind usually comprises sensors such as a timing sensor which generates a timing pulse (for the start of fuel injection) sequentially in accordance with the rotation of the crank shaft of the engine, a crank angle sensor (cylinder discrimination sensor) which generates a crank angle pulse (cylinder discrimination pulse) at a predetermined crank angle in an interval of two rotations of the crank shaft (crank angle of 720°), an intake manifold pressure sensor, and intake air temperature sensor, a coolant temperature sensor, and a throttle position sensor, etc., and a controller including CPU, RAM, ROM, A/D converter and input-output interfaces, and injectors fixed to the cylinders of the engine.

FIG. 1 shows waveforms for explaining the operation of the prior art electronic fuel injection control system in case of a four-cylinder engine.

Figure 1:
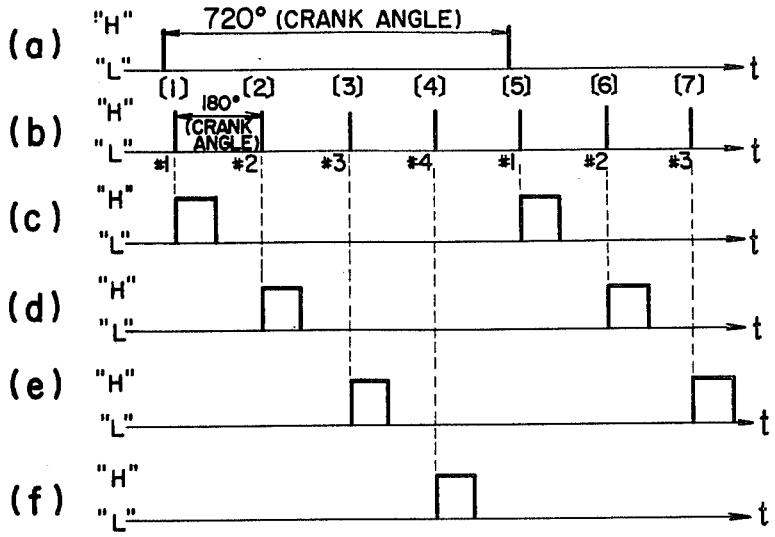
FIG. 1 PRIOR ART
FIG. 1 shows waveforms for explaining the operation of the prior art electronic fuel injection control system.

FIG. 1 shows at (a) the output of the crank angle sensor. A crank angle pulse is generated at a predetermined crank angle in two rotations of the crank shaft (crank angle of 720°). FIG. 1 shows at (b) the output of the timing sensor, in which four timing pulses are generated at equal intervals at a constant engine speed in two rotations of the crank shaft. FIG. 1 at (c), (d), (e) and (f) shows fuel injection control signals respectively applied to the injectors of the four cylinders of the engine. The injectors are opened for a period during which the fuel injection control signal remains at an "H" level so that the fuel is injected. The "H" level period of the fuel injection control signal is determined by the result of calculation of the controller based on the information from the afore-mentioned sensors.

As shown in FIG. 1, immediately after the output (a) of the crank angle sensor becomes "H" level, a fuel injection control signal (c) is applied to the injector #1 by a timing pulse [1] generated by the timing sensor.

Other fuel injection control signals are applied to the injector #2 by a next timing pulse [2], to the injector #3 by a timing pulse [3], and to the injector #4 by a timing pulse [4].

In the fuel injection control described above the timing pulses [1] to [4] are established as to their correspondence to the respective injectors #1 to #4 based on the crank angle pulse. Namely, the timing pulse generated just after the crank angle pulse is assumed to be a timing pulse for the injector #1, and the next timing pulse [2] is assumed to be a timing pulse for the injector #2, and so on. As can be seen from FIG. 1, two kinds of sensors are necessary; the timing sensor for indicating a fuel injection starting time (output (b) in FIG. 1) and the crank angle sensor (cylinder discrimination sensor) for indicating the passing of the crank shaft at a predetermined position of the crank angle (output (a) of FIG. 1) in two rotations of the crank shaft.

With only the output of the timing sensor, although the timing to start fuel injection can be determined, the injector which should be actuated for injection is left unknown.

For the purpose of discriminating the injector number #, the crank angle sensor is required. In the case of four cylinders, when the first output of the timing sensor becomes "H" after the output of the crank angle sensor becomes "H," the fuel injection is started with the injector #1. Fuel injection of the injector #2 is then started by the next timing pulse, and so on ((c) to (f) in FIG. 1 show the timing of injectors #1 to #4). Drawbacks with the use of two kinds of sensors are that the system becomes expensive and that the number of inputs to the control unit is large.

This invention aims to solve the above-mentioned defects. An embodiment of this invention will be explained hereinafter.

Figure 2:
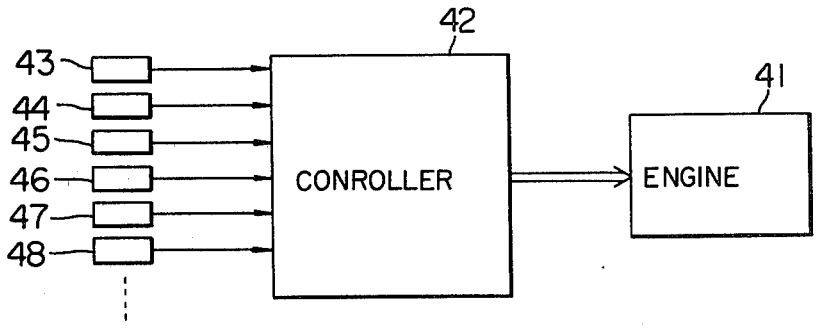
FIG. 2 is a block diagram of the electronic fuel injection control system incorporating the fuel injection timing signal and crank angle signal generating apparatus according to this invention.
Figure 6:
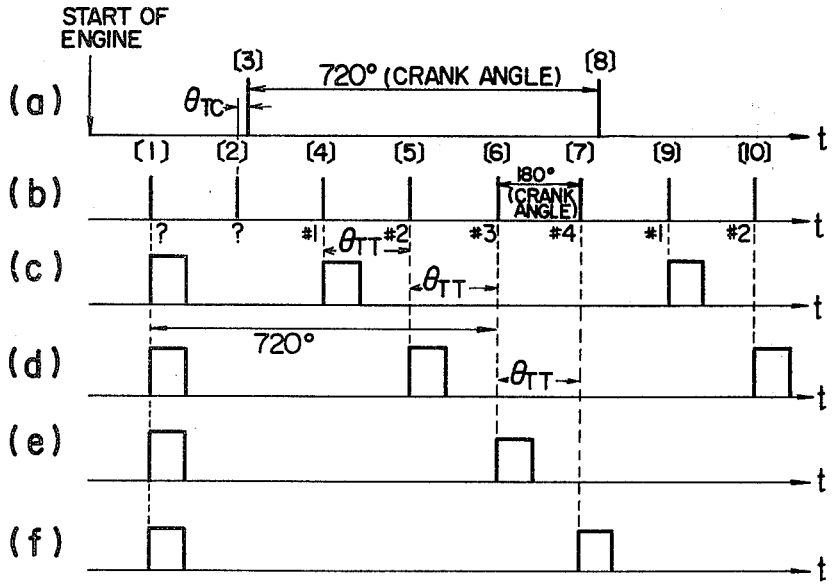
FIG. 6 shows waveforms illustrating the relationships between the crank angle signals, timing signals and fuel injection control signals according to this invention.

FIG. 2 shows a block diagram of an electronic fuel injection control system incorporating the fuel injection timing signal and crank angle signal generating apparatus. In this figure, a reference numeral 41 denotes a four-cylinder engine. An injector (not shown) is fixed to each cylinder. 42 denotes a controller which calculates the quantity of fuel injection of the engine 41 and generates a fuel injection control signal to each injector. The controller 42 is formed by a CPU, RAM, ROM, A/D converter and input-output interfaces. 43 is a rotation sensor which generates a pulse every two rotations of the crank shaft (which is to be identified as a crank angle pulse (a) in FIG. 6) and four pulses of equal intervals every two rotations the crank shaft at a constant engine speed (which are to be identified as timing pulses (b) in FIG. 6) in response to the rotation of the crank shaft. 44 is an intake manifold pressure sensor, 45 is an intake air temperature sensor, 46 is a coolant temperature sensor, and 47 is a throttle position sensor. The basic quantity of fuel injection is calculated based on the information of the engine speed obtained by the rotation sensor 43 and the information obtained by the intake manifold pressure sensor 44. A correction of the basic fuel injection quantity is made by the information from the intake air temperature sensor 45, coolant temperature sensor 46 throttle position sensor 47, etc.

According to this invention two kinds of sensors in the prior art, that is, the crank angle sensor and the timing sensor, are united to one kind of sensor. Furthermore no special discrimination circuit is needed for the discrimination of the pulse generated every two rotations of the crank shaft (to be used as a crank angle signal) and the four pulses generated every two rotations of the crank shaft (to be used as the timing signals). Instead, the discrimination process is performed by the controller 42 to which these pulses are introduced.

If the interval of the fuel injection between individual injectors is as assumed to be $\theta_{TT}$ in the unit of crank angle, the rotation sensor 43 is so constructed that a would-be crank angle pulse is generated delayed by $\theta_{TC}$ in the unit of crank angle (the relation between $\theta_{TT}$ and $\theta_{TC}$ is approximately given by $\theta_{TC} \leqq \theta_{TT}/3$) with respect to a would-be reference timing pulse which indicates a fuel injection timing used as a reference. The interval of the pulses from the rotation sensor 43 is examined at every generation of each pulse. If the ratio $T_{NEW}/T_{OLD}$ is less than or equal to a predetermined value, where $T_{OLD}$ is the interval of two previous pulses and $T_{NEW}$ is the interval between the last previous pulse and a present pulse, it is determined that the present pulse represents a crank angle pulse. Otherwise, it is determined as a timing pulse. Depending on the number of pulses determined as the timing pulses after the determination of the crank angle pulse, it is determined which injector should be actuated for fuel injection.

Figure 3:
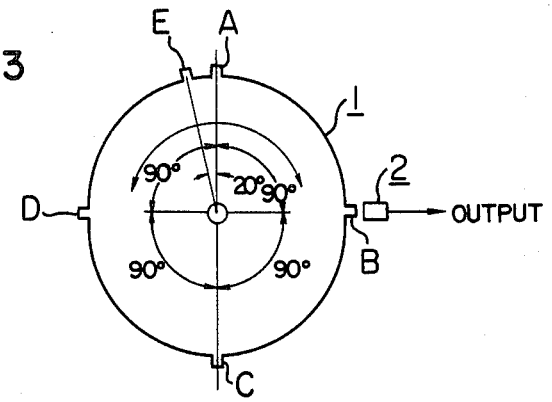
FIG. 3 shows schematically the construction of a rotation sensor according to an embodiment of this invention.
Figure 4:
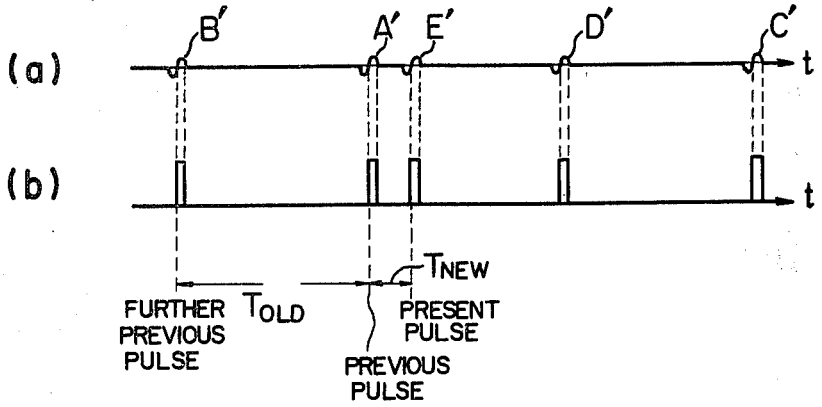
FIG. 4 shows waveforms of outputs of the apparatus of FIG. 3.

FIG. 3 shows an example of the construction of the rotation sensor 43 in a four-cylinder engine. FIG. 4 shows the output wave forms of the rotation sensor 43.

In FIG. 3, a reference numeral 1 denotes a disk of magnetic material fixed to, e.g., a crank cam shaft in such a manner that it rotates once for every two rotations of the crank shaft. Projections A to D are provided at an interval of 90° (corresponds to a crank angle of 180° or $\theta_{TT}$). The outputs of a sensor 2 due to these projections A to D become timing pulses. The sensor 2 includes, for example, a magnet having one end located to face the projections of the disk 1 as the disk 1 rotates, and includes a coil (not shown) wound around the magnet. Another projection E is provided at a position behind the position of the projection A with respect to the direction of the rotation of the disk 1 by 20° (crank angle of 40° or $\theta_{TC}$). The output of the sensor 2 produced by this projection E is used as a crank angle pulse.

Next, explanation will be made as to a method for discriminating a crank angle pulse from timing pulses in the outputs of the sensor 2.

FIG. 4 shows at (a) the outputs A'–E' of the sensor 2, and at (b) wave forms obtained by shaping the outputs A'–E'. These pulses are introduced into the controller (FIG. 2, 42), in which the CPU (e.g., MC6801 of Motorola Co. Ltd.) having a function of interval timer measures the period of each output pulse of the sensor 2 from the previous pulse at every rise of the pulse. In FIG. 4 at (a), B', A', E', D', C' denotes outputs corresponding to the projections B, A, E, D and C respectively.

Here, if the relation between the pulse period $T_{OLD}$ measured previously and the pulse period $T_{NEW}$ measured presently is given by $$\frac{T_{NEW}}{T_{OLD}} < \frac{1}{2}, \quad (1)$$

it is determined that the present output pulse is a crank angle pulse. If the relation (1) is not satisfied, the pulse is determined to be a timing pulse.

Supposing that the rotation of the engine is not varied, and if the present output pulse is a crank angle pulse, we have $$\frac{T_{NEW}}{T_{OLD}} = \frac{40}{180} = \frac{2}{9},$$

while if it is a timing pulse we have $$\frac{T_{NEW}}{T_{OLD}} = \frac{180}{40} \text{ or } \frac{180}{180} \text{ or } \geqq 1$$

Therefore, even if the engine speed has a certain variation, no erroneous determination will occur.

Figure 5:
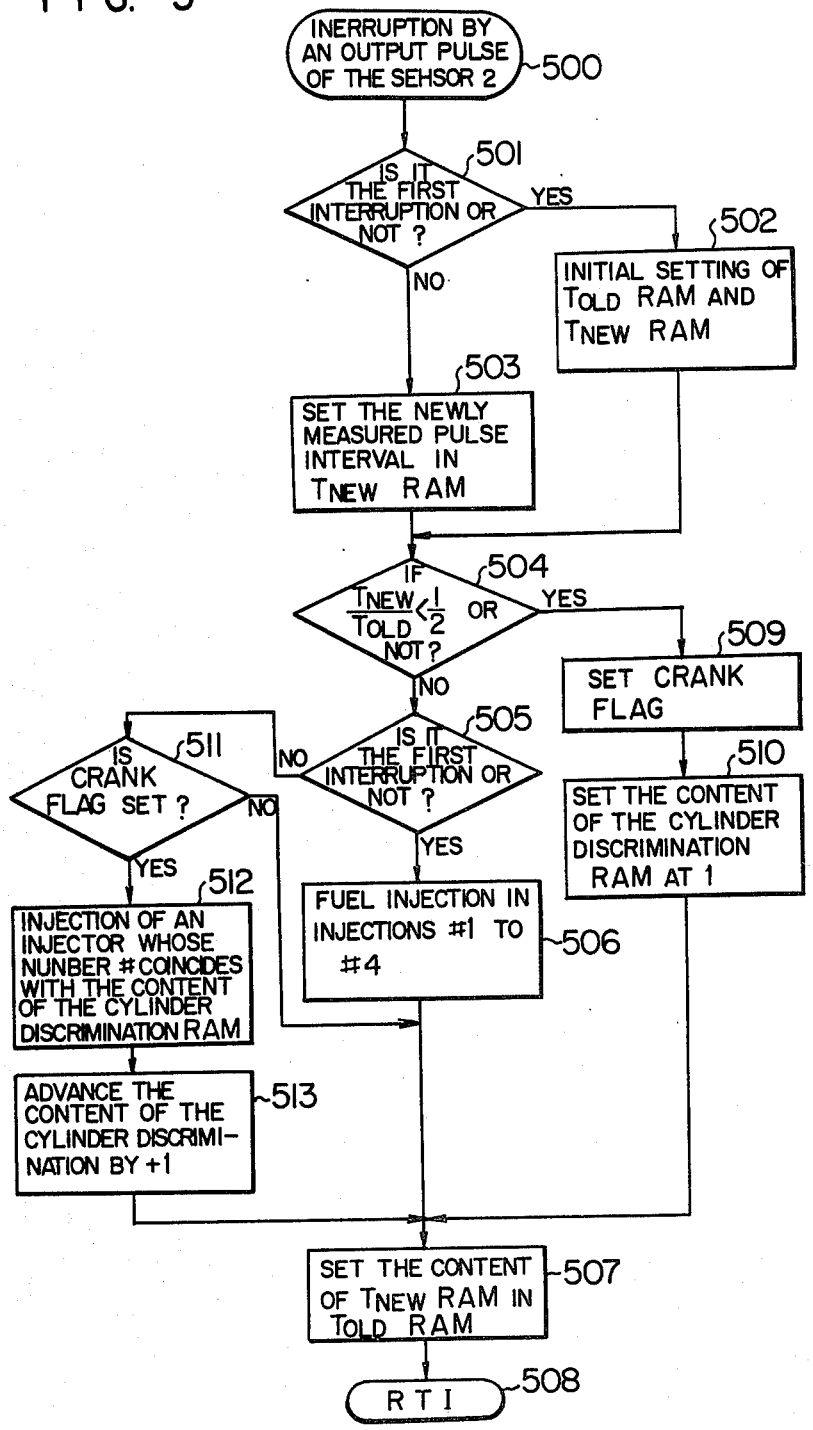
FIG. 5 is a flow chart for explaining the operation of the controller of FIG. 2.

FIG. 5 shows a flow chart of discrimination between the crank angle pulse and the timing pulse and the fuel injection control. Description will be made as to the interrupt action by the crank angle pulses and timing pulses [1] to [10] as shown at (a) and (b) in FIG. 6 with reference to FIG. 5.

In case of interruption by a timing pulse [1]; in steps of 500 and 501, it is determined whether it is the first interruption or not, if it is YES, then initial setting of $T_{OLD}$ RAM (a memory which stores a previous pulse interval) and $T_{NEW}$ RAM (a memory of a present pulse interval) is made in Step 502, in step 504, it is determined whether $$\frac{T_{NEW}}{T_{OLD}} < \frac{1}{2}$$

or not, if it is NO, then in step 505 it is determined whether it is first interruption or not, if it is YES, in step 506 fuel injection in all injectors #1 to #4 is made, in step 507 the content of $T_{NEW}$ RAM is set in $T_{OLD}$ RAM, then proceed to step 508 for return to interruption.

In case of interruption by a timing pulse [2], the process steps are 500→501, if it is NO, in Step 503 the newly measured pulse interval in $T_{NEW}$ RAM is set, →504, if it is NO, →505, if it is NO, in step 511 it is determined if the CRANK FLAG (flagged when a crank angle pulse is detected) is set or not, if it is NO, →507→508.

In case of interruption by a crank angle pulse [3]; the process steps are 500→501→503→504, if it is YES, in step 509 CRANK FLAG is set, then in step 510 the content of the cylinder discrimination RAM is set at 1, and the steps are processed to 507 and to 508.

In case of interruption by a timing pulse [4]; the process steps are from 500→501→503→504→505→511. If it is YES in step 511, then in step 512 fuel injection is made to an injector whose number # coincides with the content of the cylinder discrimination RAM, and in step 513 the content of the cylinder discrimination RAM is advanced by +1, and the process then proceeds to steps 507 and 508.

In case of interruption by a timing pulse [5], [6] or [7]; the process steps are 500→501→503→504→505→511→512→513→507→508.

In case of interruption by a timing pulse [8]; the process steps are 500→501→503→504→509→510→507→508.

In case of interruption by timing pulses [9] and [10]; the process steps are

500→501→503→504→505→511→512→513→507→508.

Although the above explanation is made as applied to the electronic fuel injection control system for a four-cylinder engine where each cylinder has an injector and the fuel injection by each injector occures at a different crank angle from that of another injector, it may be applied to 6- and 8-cylinder engines. Furthermore, the fuel injection sequence is not limited to that shown in FIG. 6 wherein the timing of fuel injection differs for each injector, but may be applied equally to a case where two injectors perform fuel injection simultaneously, or to a case where the injection interval is not uniform. In the case where the interval of fuel injection is not uniform, it is desirable that $\theta_{TC}$ is less than or equal to $\frac{1}{3}\theta_{TT(MIN)}$, where $\theta_{TT(MIN)}$ is a minimum value of $\theta_{TT}$, or a shortest injection interval between any two injectors.

Although in the embodiment described in the foregoing, the rotation sensor is so constructed that the crank angle pulse (to be discriminated in the controller) is generated delayed by $\theta_{TC}$ from the reference timing pulse, it may be generated in advance of $\theta_{TC}$. In such a case, it is determined that a further previous pulse occuring before the just previous pulse is a crank angle pulse if the measured $T_{NEW}/T_{OLD}$ is larger than or equal to a predetermined value. However, where the engine speed is measured by utilizing the interval of the timing pulses, it might be inconvenient for the measurement of the engine speed since the discrimination of a crank angle pulse cannot be completed until one, or two pulses appear after the would be crank angle pulse has occured.

As described above, according to this invention, the functions performed by two kinds of sensors in the prior art can be achieved only by one kind of sensor. Furthermore, the discrimination between the crank angle and timing pulses can be attained by an alteration of the program of the CPU to perform the steps in FIG. 5 in the controller having the function of an interval timer.

What is claimed is:

1. A fuel injection timing signal and crank angle signal generating apparatus for an electronic fuel injection control system for vehicle engines comprising:

a rotation sensor for generating a first pulse at every cycle of fuel injection of an engine and a second series of pulses in said every cycle of fuel injection, said second series of pulses having equal intervals at given engine revolutions each corresponding to a fuel injection interval ($\theta_{TT}$) represented by a crank angle, said first pulse being delayed from a predetermined one of said second pulses by a predetermined crank angle ($\theta_{TC}$) and satisfying a relation given by, $\theta_{TC} \leqq \theta_{TT}/3$, said first pulse and said second series of pulses being substantially of the same pulse width; and discriminating means for discriminating between a crank angle pulse and fuel injection timing pulses as to said first pulse and said second series of pulses generated by said rotation sensor, said discriminating means measuring an interval between an instant pulse and a previous pulse every time each of said first and second pulses are received sequentially in the order of generation and indiscriminately between said first and second pulses, said discriminating means comparing a last measured interval ($T_{NEW}$) with a first previously measured interval ($T_{OLD}$) and determining that an instant pulse is a said crank angle pulse if a ratio $T_{NEW}/T_{OLD}$ is less than or equal to a predetermined value, and otherwise determining that said instant pulse is one of said fuel injection timing pulses.

2. A fuel injection timing signal and crank angle signal generating apparatus comprising:

a rotation thereof for generating a plurality of first pulses at equal intervals for a given engine speed, each corresponding to a crank angle $\theta_{TT}$ while a crank shaft rotates by a predetermined number of rotations and for generating a second pulse delayed with respect to one of said first pulses by a crank angle $\theta_{TC}$ so that $\theta_{TC} \leqq \theta_{TT}/3$;

a controller for discriminated by an interruption of a pulse from said rotation sensor whether a recent received pulse is a crank angle pulse or a timing pulse and for generating a fuel injection control signal, said controller comprising;

a first means for determining whether said recent received pulse has appeared as a first interruption;

a second means for initially setting a $T_{OLD}$ memory which stores a previously measured pulse period ($T_{OLD}$) and a $T_{NEW}$ memory which stores a presently measured pulse period ($T_{NEW}$) if the determination of said first means is YES;

a third means for setting a presently measured value $T_{NEW}$ in said $T_{NEW}$ memory if the determination of said first step is NO; and a fourth means for determining whether $T_{NEW}/T_{OLD}$ is smaller than $\frac{1}{2}$ or not, thereby to discriminate between a crank angle pulse or a timing pulse.

3. A fuel injection timing signal and crank angle signal generating apparatus according to claim 2, said controller further comprising:

a fifth means for determining whether said recently received pulse has appeared as a first interruption or not when the determination of said fourth means is NO;

a sixth means for generating fuel injection control signals for all injectors if the determination of said fifth means is YES;

a seventh means for setting a CRANK FLAG when the determination of said fourth means is YES;

an eighth means for setting the content of a cylinder discrimination memory at 1 after the determination of said seventh means;

a ninth means for determining whether said CRANK FLAG is set or not if the determination of said fifth means is NO;

a tenth means for generating an injection control signal to a cylinder whose number # coincides with the content of said cylinder discrimination memory;

an eleventh means for advancing the content of said cylinder discrimination memory by +1 after the determination of said tenth means;

a twelfth means for setting the content of said $T_{NEW}$ memory in said $T_{OLD}$ memory after the determination of said eleventh means, said ninth means, said sixth means or said eighth means.

* * * * *